US007674121B2

(12) United States Patent
Khemakhem

(10) Patent No.: US 7,674,121 B2
(45) Date of Patent: Mar. 9, 2010

(54) PROTECTIVE BOOT AND UNIVERSAL CAP

(75) Inventor: M'hamed Anis Khemakhem, Minnetonka, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 12/181,777

(22) Filed: Jul. 29, 2008

(65) Prior Publication Data

US 2009/0117762 A1 May 7, 2009

Related U.S. Application Data

(60) Continuation of application No. 11/789,631, filed on Apr. 25, 2007, now Pat. No. 7,407,412, which is a division of application No. 11/488,445, filed on Jul. 17, 2006, now Pat. No. 7,226,300, which is a division of application No. 10/775,759, filed on Feb. 9, 2004, now Pat. No. 7,090,516.

(51) Int. Cl.
*H01R 13/44* (2006.01)

(52) U.S. Cl. ..... 439/135; 439/675

(58) Field of Classification Search ..... 439/135, 439/578, 350, 352, 353, 367–370, 282, 148, 439/149, 675

See application file for complete search history.

(56) References Cited

U.S. PATENT DOCUMENTS 3,124,405 A * 3/1964 Massa ..... 439/282
3,611,255 A 10/1971 Shroyer
4,030,850 A 6/1977 Hyde
4,609,247 A 9/1986 Annoot
4,707,043 A 11/1987 Reed (Continued)

FOREIGN PATENT DOCUMENTS

DE 37 35 038 A1 4/1989

(Continued)

OTHER PUBLICATIONS

Canford Audio, Online Product Catalog, 2 pages (Publicly known at least as early as Feb. 9, 2004).

*Primary Examiner*—Hae Moon Hyeon
(74) *Attorney, Agent, or Firm*—Merchant & Gould P.C.

(57) ABSTRACT

A protective endcap for use with a triaxial cable connector. The endcap is sized to fit about a mating end of the triaxial connector. A pair of protective boots for use with coaxial cable connectors. Each protective boot includes an interior space for receiving a triaxial cable connector. Each interior space includes ridges for engaging grooves about the connector. Each boot includes a mating circumferential lip about a connector end. Each boot includes a tapered cable end with an opening for a cable from a connector to extend through from the interior space. A triaxial cable connector assembly including a connector, a protective boot and an endcap. The connector is positioned within an interior opening of the boot with ridges of an inner wall of the opening engaging grooves of the connector. A cable extending from the connector extends through a cable end of the boot. A mating end of the connector is adjacent a connector end of the boot. The endcap is mounted about the mating end of the connector and includes a circumferential lip which engages a mating circumferential lip of boot.

10 Claims, 13 Drawing Sheets

U.S. PATENT DOCUMENTS

| | | | |
|---|---|---|---|
| 5,199,893 | A | 4/1993 | Fussell |
| 5,595,497 | A | 1/1997 | Wood |
| 5,605,468 | A | 2/1997 | Wood |
| 5,631,443 | A | 5/1997 | Scrimpshire et al. |
| 5,769,662 | A | 6/1998 | Stabile et al. |
| 5,885,098 | A | 3/1999 | Witkowski |
| 5,886,294 | A | 3/1999 | Scrimpshire et al. |
| 5,967,852 | A | 10/1999 | Follingstad et al. |
| 6,065,981 | A | 5/2000 | Sopotnick et al. |
| 6,109,963 | A | 8/2000 | Follingstad et al. |
| 6,179,639 | B1 | 1/2001 | Kuwahara et al. |
| 6,336,821 | B1 | 1/2002 | Hattori |
| 6,511,339 | B1 | 1/2003 | Huang |
| 6,539,161 | B2 | 3/2003 | Holman et al. |
| 6,561,848 | B1 | 5/2003 | Khemakhem et al. |
| 6,575,786 | B1 | 6/2003 | Khemakhem et al. |
| 6,665,484 | B2 | 12/2003 | Douglas et al. |
| 6,846,988 | B2 | 1/2005 | Khemakhem et al. |
| 6,955,563 | B1 | 10/2005 | Croan |
| 7,090,516 | B2 | 8/2006 | Khemakhem |
| 7,189,097 | B2 * | 3/2007 | Benham ..... 439/352 |
| 7,226,300 | B2 | 6/2007 | Khemakhem |
| 2003/0207601 | A1 | 11/2003 | Adachi |

FOREIGN PATENT DOCUMENTS

| | | | |
|---|---|---|---|
| DE | 296 08 939 | U1 | 9/1996 |
| FR | 2 725 080 | A1 | 3/1996 |
| GB | 2 203 297 | A1 | 10/1988 |
| WO | WO 03/021720 | A1 | 3/2003 |

* cited by examiner

FIG. 4
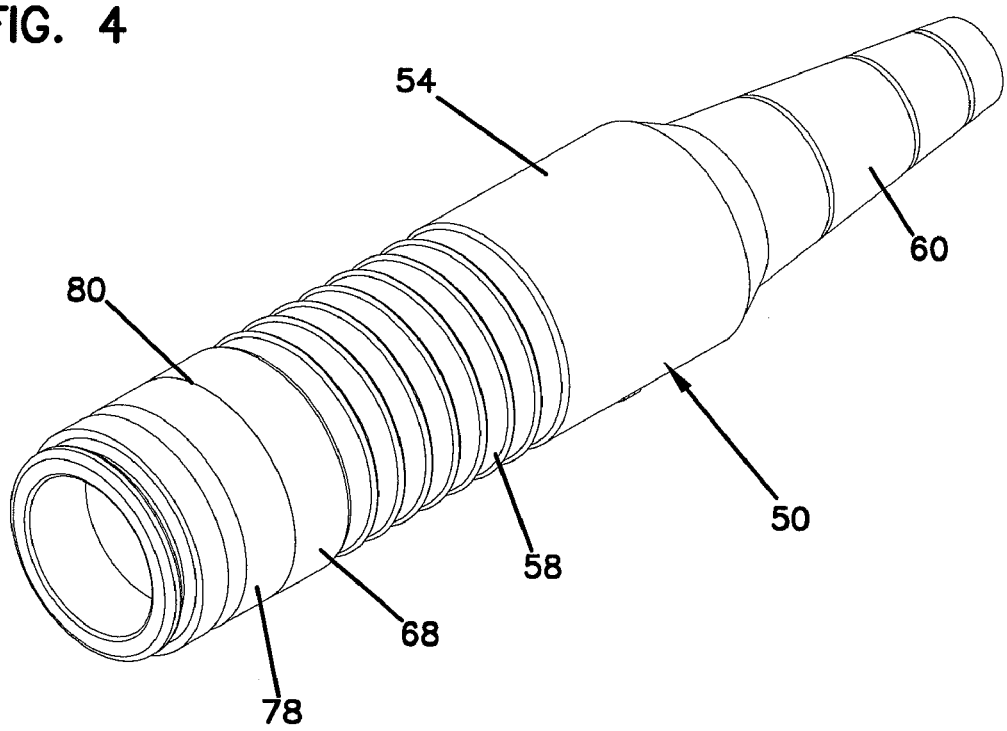
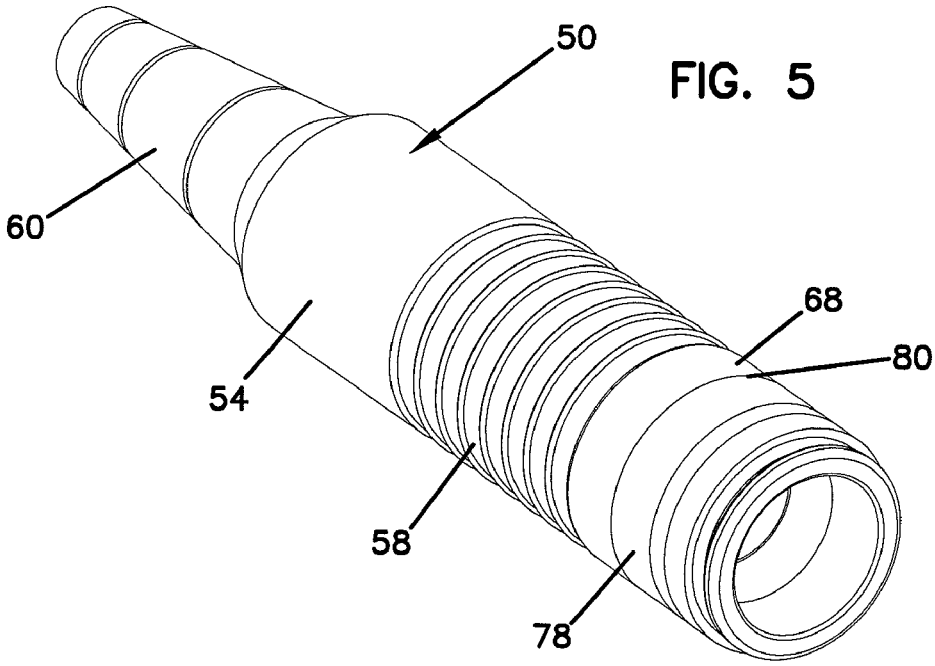
FIG. 5

FIG. 13
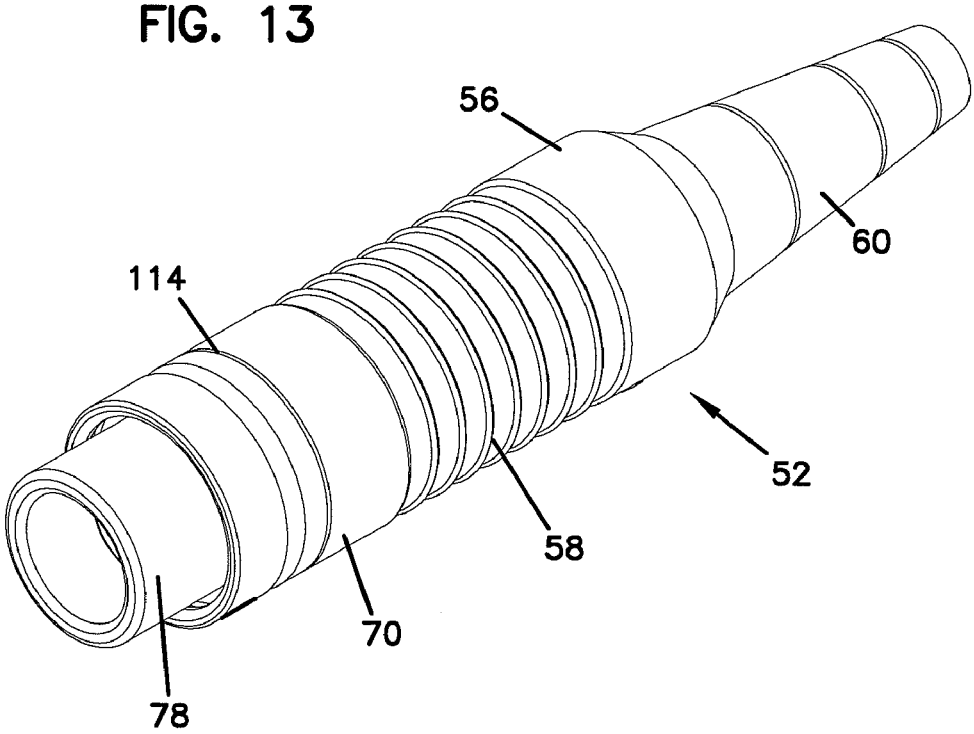
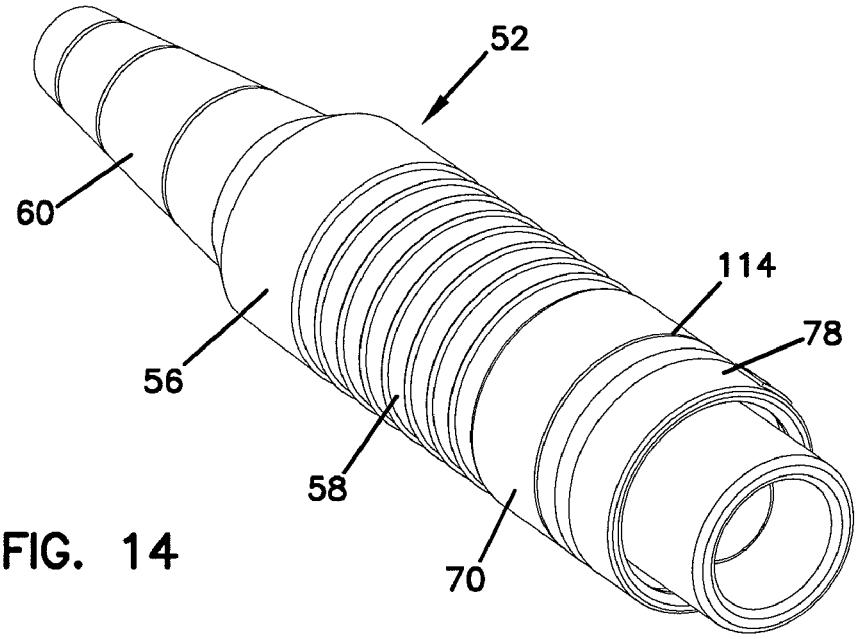
FIG. 14

PROTECTIVE BOOT AND UNIVERSAL CAP

CROSS REFERENCE TO RELATED APPLICATIONS

This application is a continuation of application Ser. No. 11/789,631, filed Apr. 25, 2007, now U.S. Pat. No. 7,407,412, which is a divisional of application Ser. No. 11/488,445, filed Jul. 17, 2006, now U.S. Pat. No. 7,226,300 B2, which is a divisional of application Ser. No. 10/775,759, filed Feb. 9, 2004, now U.S. Pat. No. 7,090,516 B2, which applications are incorporated herein by reference.

TECHNICAL FIELD

The present invention relates generally to triaxial cable connectors. More specifically, the present invention relates to protective boots and endcaps for triaxial cable connectors.

BACKGROUND

Broadcast communications equipment communicate electrical signals via triaxial cables which are well known. A variety of triaxial cable connectors of different styles and formats are known as well. Examples of such cables and connectors may be found in U.S. Pat. Nos. 5,967,852; 6,109,963; 6,539,161; and 6,665,484.

These known triaxial cable connectors are fairly durable and resistant to contamination when mated to a corresponding connector. However, it is desirable to improve the resistance to impact and to intrusion of contaminants for mated pairs of connectors.

It is also desirable to provide a device for covering the mating ends of triaxial cable connectors when the connectors are not mated with another connector. These triaxial cable connectors may be covered by a protective boot and improvements to these protective boots are desirable. Protection of bulkhead mounted triaxial connectors which are not mounted to cables is also desirable.

SUMMARY

The present invention relates to a protective endcap for use with a first cable connector and a second cable connector. The first and second connectors include mating ends adapted to electrically and physically mate with each other. The mating end of the first connector defines a first gender and the mating end of the second connector defines a second gender. The endcap includes a body with a first end and an opposing second end. The first end is adapted to mate with the first connector and the second end is adapted to mate with the second connector. The first end of the body including an opening extending into the body to receive and engage the mating end of the first connector and the second end of the body including an opening to receive and engage the mating end of the second triaxial connector. An inner bulkhead is positioned within the body closing off each of the openings.

The present invention further relates to a protective endcap for use first and second cable connectors includes mating ends. The connectors are positioned within protective boots. The mating end of the first cable connector defines a first gender and the mating end of the second cable connector defines a second gender. The mating ends of the first and second cable connectors are accessible through connector openings of the boot of each cable connector. The endcap includes a body with a first end and an opposing second end. The first end of the body includes an opening sized to receive and engage the mating end of the first cable connector. The second end of the body includes an opening sized to receive and engage the mating end of the second cable connector. The first end of the body also includes an inward facing circumferential lip for selectively engaging the connector end of the boot of the first cable connector. The second end of the body includes an outward facing circumferential lip for selectively engaging the connector end of the boot of the second cable connector.

The present invention further relates to a pair of protective boots for cable connectors including a first boot and a second boot. The first boot including a cable end and a first connector end and adapted to fit about a first cable connector with a first mating end adjacent the first connector end. The second boot including a cable end and a second connector end and adapted to fit about a second connector with a second mating end adjacent the second connector end. The first connector end including an outward facing circumferential lip, and the second connector end including an inward facing circumferential lip, the outward and inward facing circumferential lips sized and configured to engage each other when the first and second mating ends of the cable connectors are brought together to form a junction about the mating ends of the connectors.

The present invention further relates to a cable connector assembly including a first cable connector with a mating end and a cable extending away from the connector opposite the mating end. The assembly also includes a first protective boot with a circumferential mating lip at a connector opening, an interior space for receiving the first cable connector and a cable end opposite the connector opening. The first connector is positioned within the interior space of the first boot with the mating end adjacent the connector opening and the cable extending through the cable end. The assembly also includes a first endcap with a first end positioned about the mating end of the first connector. The first end includes a circumferential mating lip and the lips of the first end of the first endcap and the first boot mate to form a junction adjacent the mating end of the first connector. The first endcap also includes a second end adapted to fit about a second cable connector which includes a mating end adapted to physically and electrically mate with the mating end of the first connector. The second end is adapted to mate with and form a junction with a second protective boot positioned about the second connector.

The present invention further relates to a protective endcap for use with a first cable connector and a second cable connector. The first and second cable connectors include mating ends and are positioned within protective boots. The mating ends of the cable connectors are adapted to electrically and physically mate with each other, the mating end of the first cable connector defining a first gender and the mating end of the second cable connector defining a second gender. The mating ends of the first and second cable connectors are accessible through connector openings of the boot of each cable connector. The endcap includes a body with a first end and an opposing second end. The first end is adapted to mate with the mating end of the first cable connector and the second end adapted to mate with the mating end of second cable connector. The first end of the body includes an opening sized to receive and engage the mating end of the first cable connector. The second end of the body includes an opening sized to receive and engage the mating end of the second cable connector. The first end of the body also includes an interlock arrangement for selectively engaging and forming a junction with the boot of the first cable connector and the second end of the body includes an interlock arrangement for selectively engaging and forming a junction with the boot of the second cable connector.

The present invention also relates to a pair of protective boots for cable connectors. The first boot includes a cable end and a first connector end and is adapted to fit about a first cable connector with a first mating end adjacent the first connector end. The second boot includes a cable end and a second connector end and is adapted to fit about a second connector with a second mating end adjacent the second connector end. The first connector end and the second connector end include an interlocking arrangement to selectively engage each other and form a junction about the mating ends of the connectors when the first and second mating ends of the cable connectors are brought together.

The present invention further relates to a method of connecting cable connectors. The method includes providing first and second cable connectors and first and second protective boots mounted about the first and second connectors. The first connector includes a first mating end and the second connector includes a second mating end, and each of the first and second boots includes a connector end. The first and second mating ends are mated so that the first and second connectors are electrically and physically joined. The connector ends of the first and second protective boots are interlocked to form a junction about the first and second mating ends.

The present invention further relates to a method of covering a mating end of a cable connector. The method includes providing a cable connector of a first or a second gender. The genders are defined so that a connector of the first gender mates with a connector of the second gender. An appropriate end of a dual ended endcap is selected and mated with the mating end of the connector.

BRIEF DESCRIPTION OF THE DRAWINGS

The accompanying drawings, which are incorporated in and constitute a part of the description, illustrate several aspects of the invention and together with the description, serve to explain the principles of the invention. A brief description of the drawings is as follows:

FIG. 4 is a first perspective view of one of the pair of triaxial connectors of FIG. 1, with a protective endcap according to the present invention.

FIG. 5 is a second perspective view of the triaxial connector of FIG. 4.

FIG. 13 is a first perspective view of the second of the pair of triaxial connectors of FIG. 1, with the protective endcap of FIG. 4.

FIG. 14 is a second perspective view of the triaxial connector of FIG. 13.

DETAILED DESCRIPTION

Reference will now be made in detail to exemplary aspects of the present invention which are illustrated in the accompanying drawings. Wherever possible, the same reference numbers will be used throughout the drawings to refer to the same or like parts.

Figure 21:
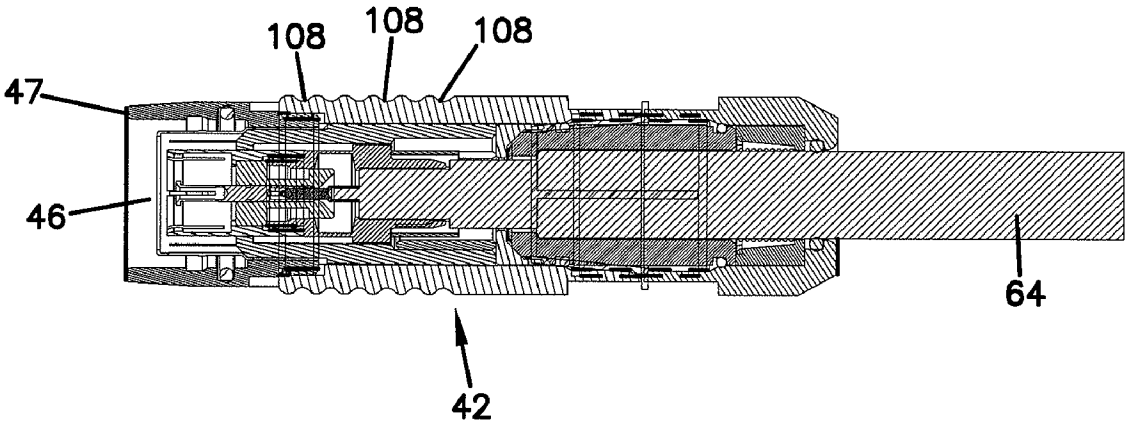
FIG. 21 (PRIOR ART)
FIG. 21 is a cross-section view of the triaxial connector of FIG. 16, with the protective boot removed.
Figure 12:
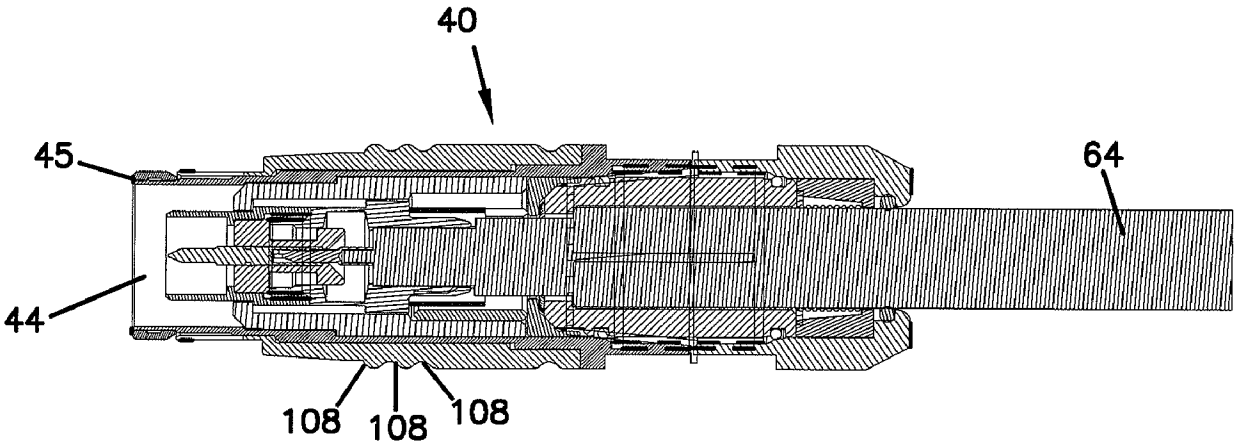
FIG. 12 (PRIOR ART)
FIG. 12 is a cross-sectional view of the triaxial connector of FIG. 7, with the protective boot removed.

Cable connectors for triaxial cables, such as prior art connectors 40 and 42, respectively, of FIGS. 12 and 21, may be used to terminate triaxial cables 64 for use in the broadcast communications industry. Such cables 64 may be used to connect a variety of pieces of equipment, such as cameras and production devices, and may be used in installations that are subject to adverse environmental exposure, such as remote broadcast locations or sports stadiums. Often, once cables 64 have been connected using connectors 40 and 42, the mated pair may simply be placed on the ground. Cables 64, with connectors 40 and 42, may also be laid in such harsh environments in anticipation of use and exposing connectors 40 and 42 to the environment without being joined with a mating connector.

Figure 1:
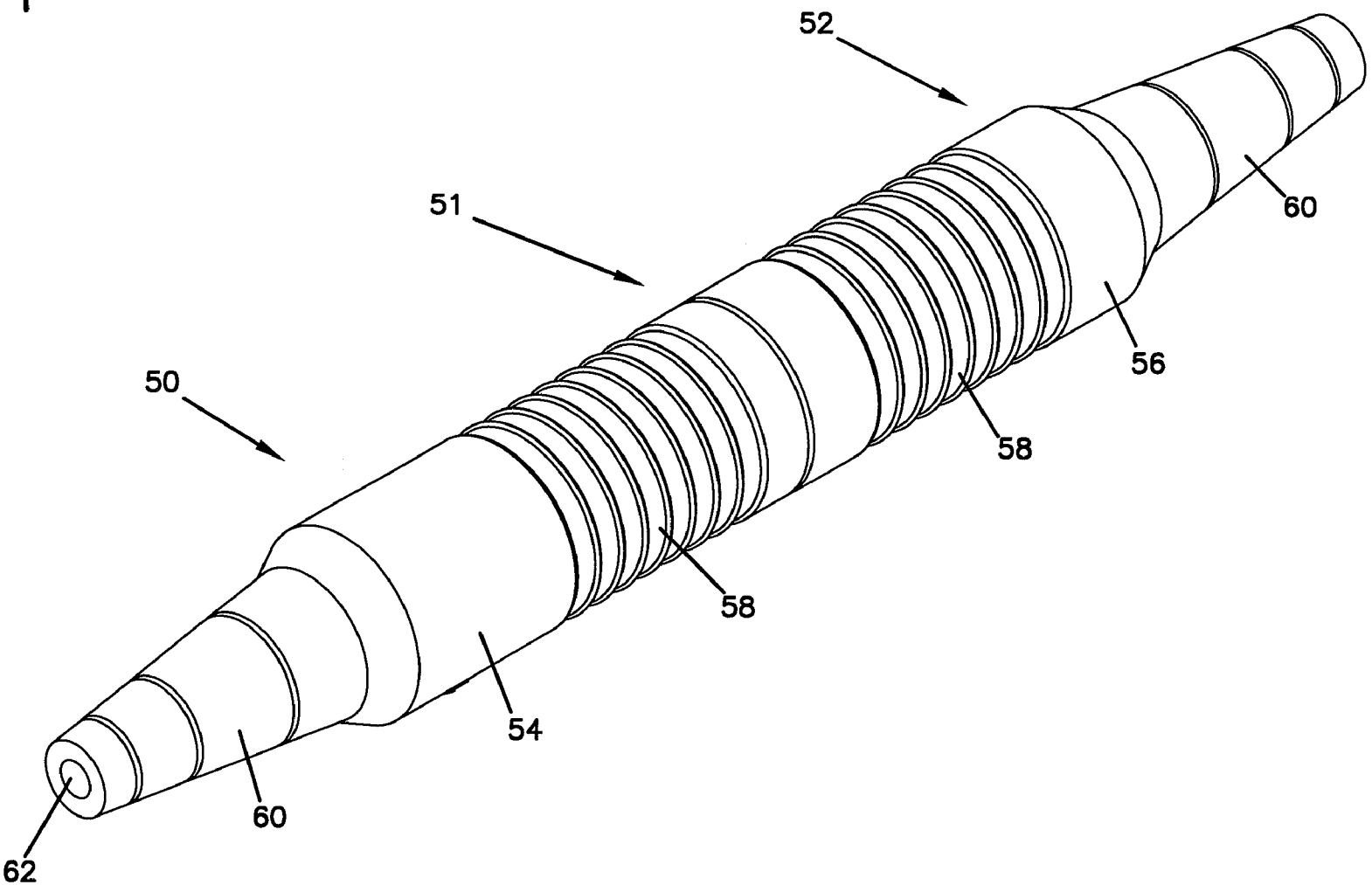
FIG. 1 is a perspective view of a pair of mated triaxial cable connectors with connector boots according to the present invention.
Figure 2:
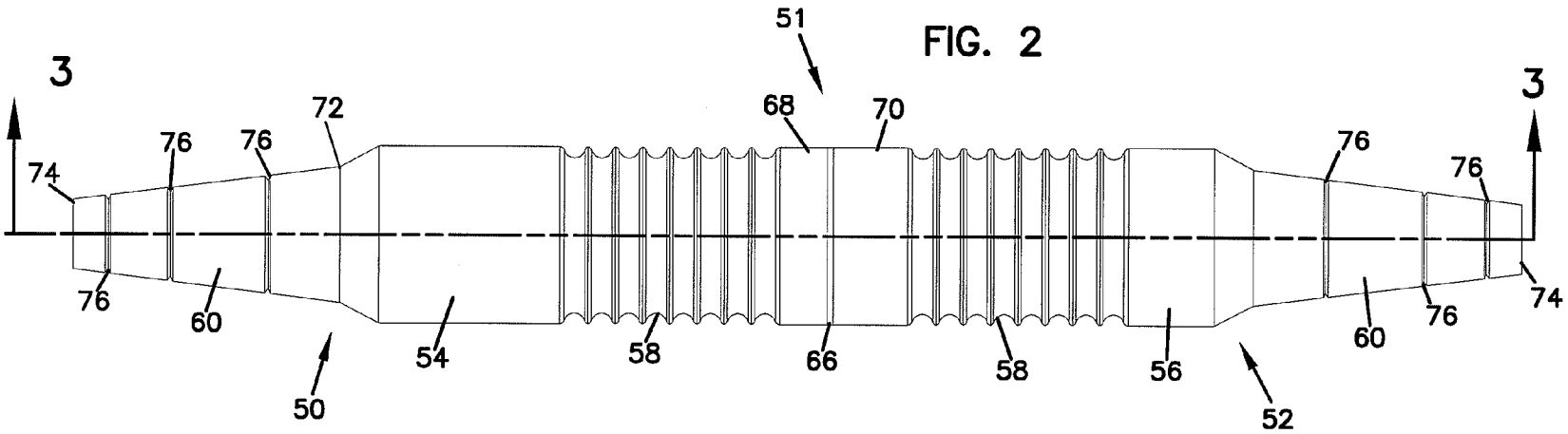
FIG. 2 is a side view of the pair of triaxial connectors with boots of FIG. 1.
Figure 3:
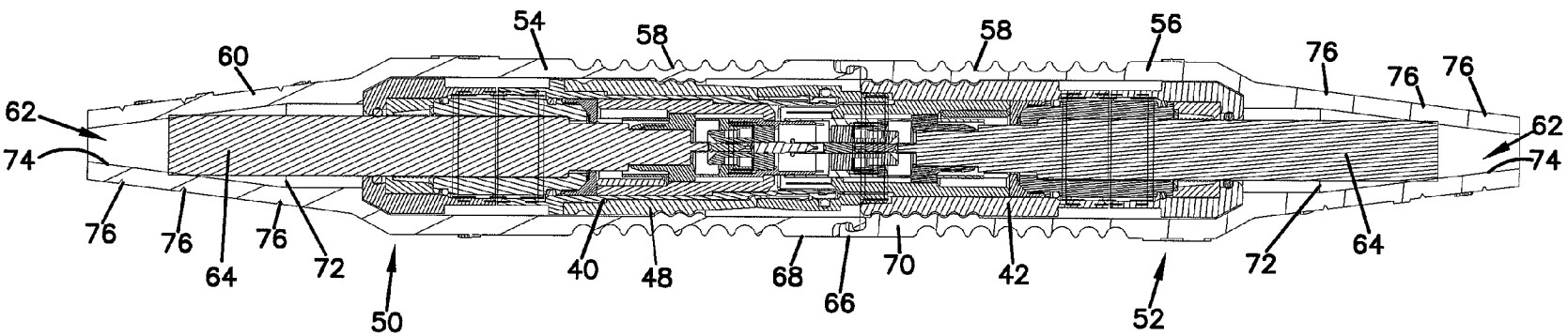
FIG. 3 is a cross-sectional view of the pair of triaxial connectors with boots of FIG. 1, taken along line 3-3 in FIG. 2.

FIGS. 1 to 3 show a pair of triaxial cable connector assemblies 50 and 52, mated as a pair 51. Connector assembly 50 includes a protective boot 54 mounted about connector 40 (shown in the cross-sectional view of FIG. 3) while connector assembly 52 includes a mating protective boot 56 mounted about a connector 42 (shown in the cross-sectional view of FIG. 3).

Boots 54 and 56 each include a grooved gripping surface 58 and a tapered cable end portion 60 with an opening 62 for a triaxial cable 64 (shown in FIG. 3) to extend from the connector within each boot. Gripping surface 58 permits a user to securely grasp either connector 50 or 52 and exert proper axially tension on a locking mechanism of connector 40 or 42 to release the mating connectors of pair 51. Such locking mechanisms are well known in the art and are described in U.S. Pat. Nos. 5,967,852; 6,109,963; 6,539,161; and 6,665,484, the disclosures of which are incorporated herein by reference. These mechanisms resist un-mating of connectors when tension is applied to cables 64 and permit un-mating when outer sleeves 48 of connectors 40 and 42 are moved axially relative to the rest of the connector. In pair 51, boots 54 and 56 meet, overlap and engage each other to form a junction 66 at distal ends 68 and 70, respectively, of each boot. Junction 66 may preferably be water, air or dust resistant, or may be an area of engagement of boots 54 and 56.

Referring now to FIGS. 2 and 3, cable end portion 60 is a smoothly tapered portion of boots 54 and 56, transitioning smoothly from a wide end 72 within opening 62 to a narrow end 74 of opening 62. A plurality of circumferential grooves 76 are formed in cable end portion 60 at different distances between ends 72 and 74. Grooves 76 are located along the smooth taper of cable end portion 60 so that cutting cable end portion 60 along one of these grooves 76 will create a new narrow end of opening 62 corresponding to the diameter of one of several triaxial cable sizes. As shown in FIG. 3, cable 64 corresponds in size to a new narrow end to opening 62 that would be created by cutting cable end portion 60 at the middle groove 76. Cutting along groove 76 nearest narrow end 74 would create a smaller entry into opening 62, corresponding to a smaller diameter triaxial cable. Conversely, cutting cable end portion 60 at groove 76 nearest wide end 72 would create a larger entry into opening 62, corresponding to a larger diameter triaxial cable. More or fewer grooves 76 may be provided to denote entry sized corresponding to additional triaxial cables and cable end portion 60 may also be cut anywhere between wide end 72 and narrow end 74 to suit the particular triaxial cable to which connector 40 or 42 might be mounted.

Referring now to FIGS. 4 to 7, connector assembly 50 is shown with an endcap 78 engaging boot 54 at distal end 68, forming a junction 80. Junction 80 is similar to junction 66, shown in FIG. 3, above, as endcap 78 is configured to engage boot 54 in the same manner as distal end 70 of boot 56. Endcap 78 includes a first end 84 adapted to fit about a mating end 44 of connector 40. Endcap 78 also includes an inwardly facing lip 90 which is configured to engage an outwardly facing lip 92 of distal end 68 of boot 54 to form junction 80. A circumferential finger groove 82 extends about endcap 78 at an intermediate point between first 84 and a second opposite end 86 and provides enhanced grip for removal of endcap 78 from boot 54. Additional detail of endcap 78 is provided below with regard to FIGS. 22 to 27.

FIGS. 8 to 11 show boot 54 removed from about connector 40. A connector opening 94 is opposite from cable end 60 and allows entry through distal end 68 into an interior space 95, where connector 40 may be positioned. Within interior space 95 are a plurality of ridges 106 which cooperate with a mating plurality of grooves 108 about the locking mechanism of connector 40 (shown in FIG. 12). Ridges 106 and grooves 108 cooperate to permit a user to grasp gripping surface 58 about boot 54 of connector assembly 50 and retract the locking mechanism of connector 40, permitting connector 40 to be disengaged from a mating connector, such as connector 42.

Figure 7:
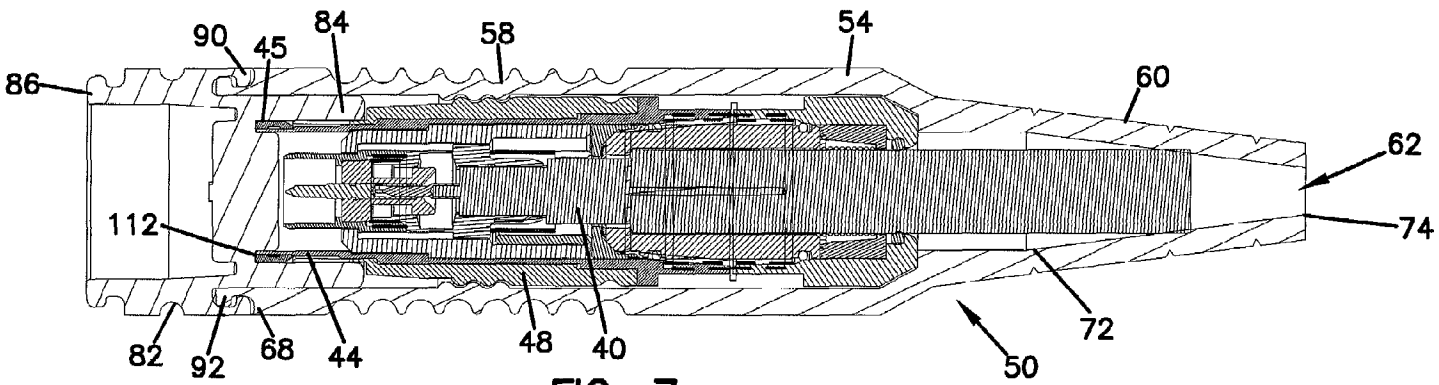
FIG. 7 is a cross-sectional view of the triaxial connector of FIG. 4, taken along line 7-7 in FIG. 6.
Figure 8:
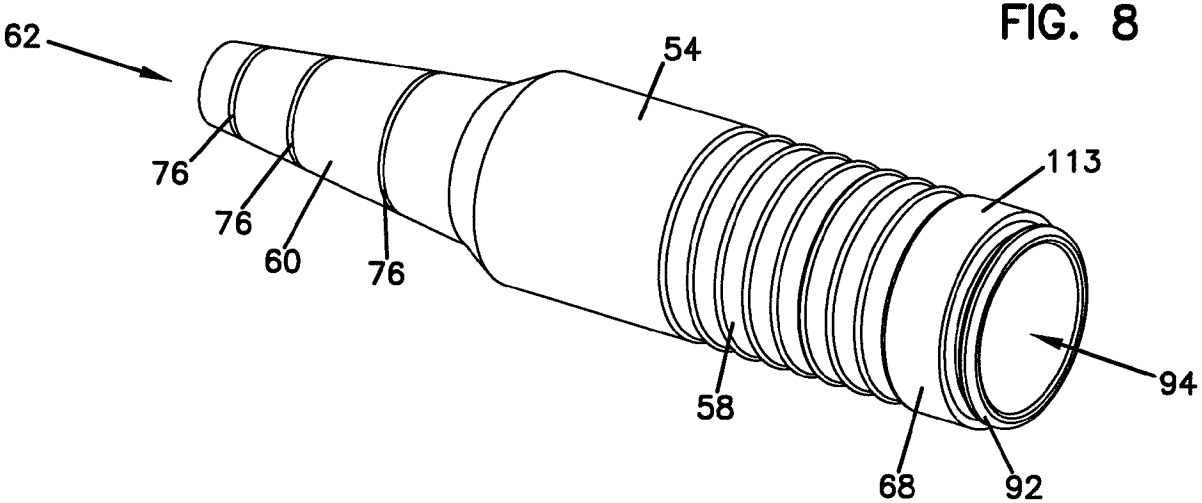
FIG. 8 is a perspective view of the protective boot of the triaxial connector of FIG. 4, removed from the triaxial connector.
Figure 10:
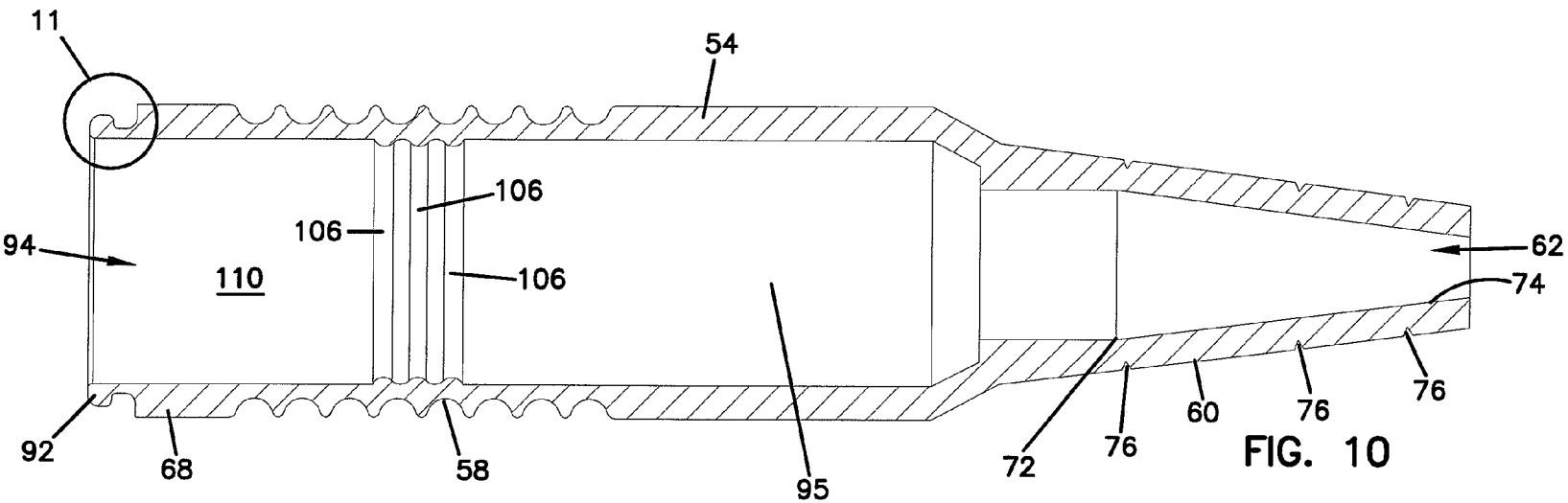
FIG. 10 is a cross-sectional view of the protective boot of FIG. 8, taken along line 10-10 in FIG. 9.

Referring now to FIGS. 7, 10 and 12, interior space 95 of boot 54 includes an inner wall 110, between grooves 106 and distal end 68. Mating end 44 of connector 40 extends within interior space 95 adjacent distal end 68 of boot 54. When inserted within connector assembly 50, first end 84 of endcap 78 extends about mating end 44 and within inner wall 110. When endcap 78 is fully inserted within connector assembly 50 such that lips 90 and 92 are engaged to form junction 80, a first intermediate wall 112 within endcap 78 engages a distal end 45 of mating end 44. First end 84 is sized and configured to fit closely about mating end 44 so that endcap 78 may also be used with connector 40 which is not mounted within boot 54. Junction 80 would not be formed, as there would be no outwardly facing lip 92 to engage inwardly facing lip 90. However, endcap 78 would still be held securely and removably to mating end 44 of connector 40 by friction between first end 84 and mating end 44. First intermediate wall 112 of endcap 78 would also engage distal end 45 of mating end 44.

Figure 11:
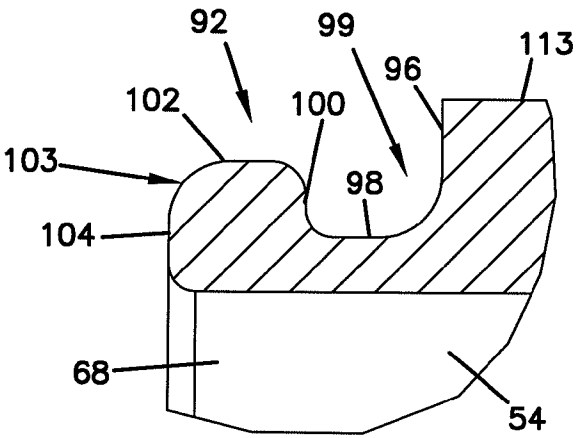
FIG. 11 is a closer view of a lip along a distal end of the boot of FIG. 8, corresponding with circle 11 of FIG. 10.
Figure 9:
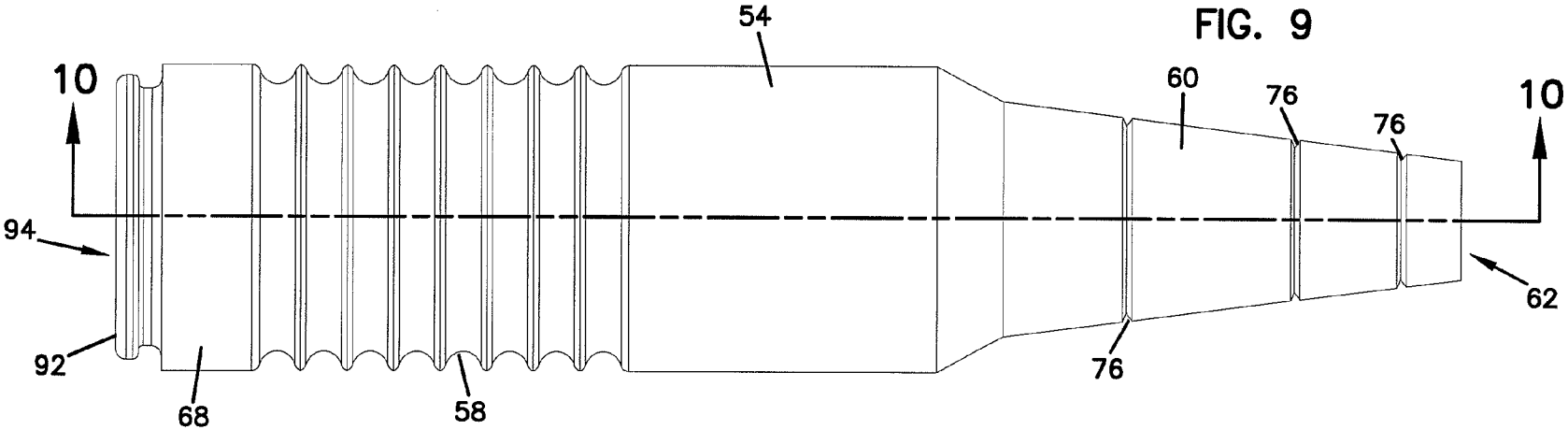
FIG. 9 is a side view of the protective boot of FIG. 8.

FIG. 11 shows outward facing lip 92 adjacent distal end 68 of boot 54, with lip 92 including an outward facing circumferential ridge 103 and an outward facing circumferential groove 99. Ridge 103 is defined by a distal end face 104, a raised outward facing surface 102 and a first end face 100. Groove 99 is defined by first end face 100, a base 98 and a second end face 96 which extends outward from base 98 to an outer wall 113 of boot 54. As shown, circumferential groove 99 is sized to receive an inward facing ridge of a similar size and shape to ridge 103. Alternatively, ridge 103 and groove 99 could be of different sizes and shapes.

Referring now to FIGS. 13 to 16, connector assembly 52 is shown with endcap 78 inserted through distal end 70 of boot 56. A junction 114 is formed between endcap 78 and boot 56 adjacent at distal end 70. As discussed above, connectors 40 and 42 are similarly arranged except they have different mating ends 44 (for connector 40) and 46 (for connector 42) defining different genders which mate to form a physical and electrical connection. Except as noted here, boot 56 is similarly configured to boot 54. Endcap 78 is the same as shown within connector assembly 50, above, with second end 86 inserted within distal end 70 of boot 56. Adjacent distal end 70 on boot 56 is an inwardly facing lip 116 which mates with an outwardly facing lip 120 on second end 86 of endcap 78.

FIGS. 17 to 20 show boot 56 removed from about connector 42. A connector opening 122 is opposite from cable end 60 and allows entry through distal end 70 into an interior space 126, where connector 42 may be positioned. Within interior space 126 are a plurality of ridges 106 on an inner wall 128. Ridges 106 cooperate with a mating plurality of grooves 108 about the locking mechanism of connector 42 (shown in FIG. 21). Ridges 106 and grooves 108 cooperate to permit a user to grasp gripping surface 58 about boot 56 of connector assembly 52 and retract the locking mechanism of connector 42, permitting connector 42 to be disengaged from a mating connector, such as connector 40.

Figure 16:
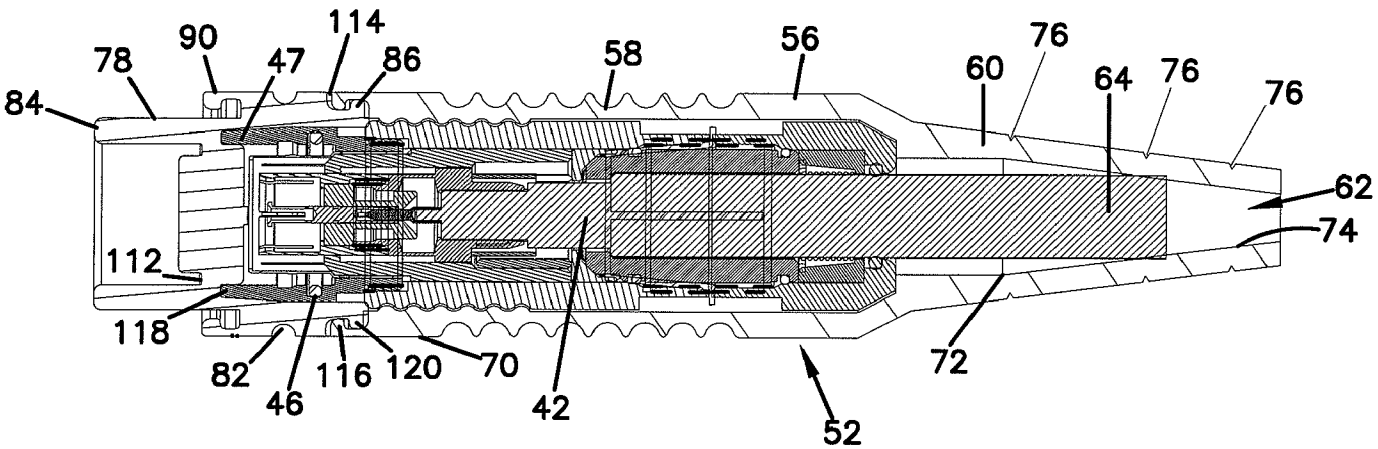
FIG. 16 is a cross-sectional view of the triaxial connector of FIG. 14, taken along line 16-16 in FIG. 15.
Figure 17:
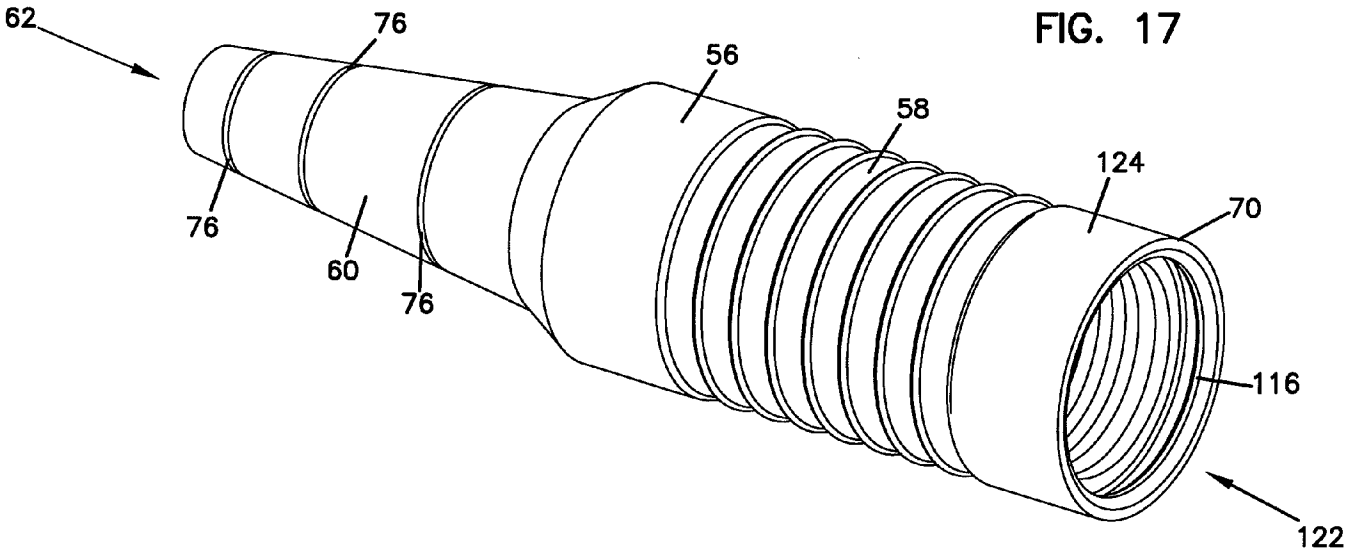
FIG. 17 is a perspective view of the protective boot of the triaxial connector of FIG. 13, removed from the connector.
Figure 18:
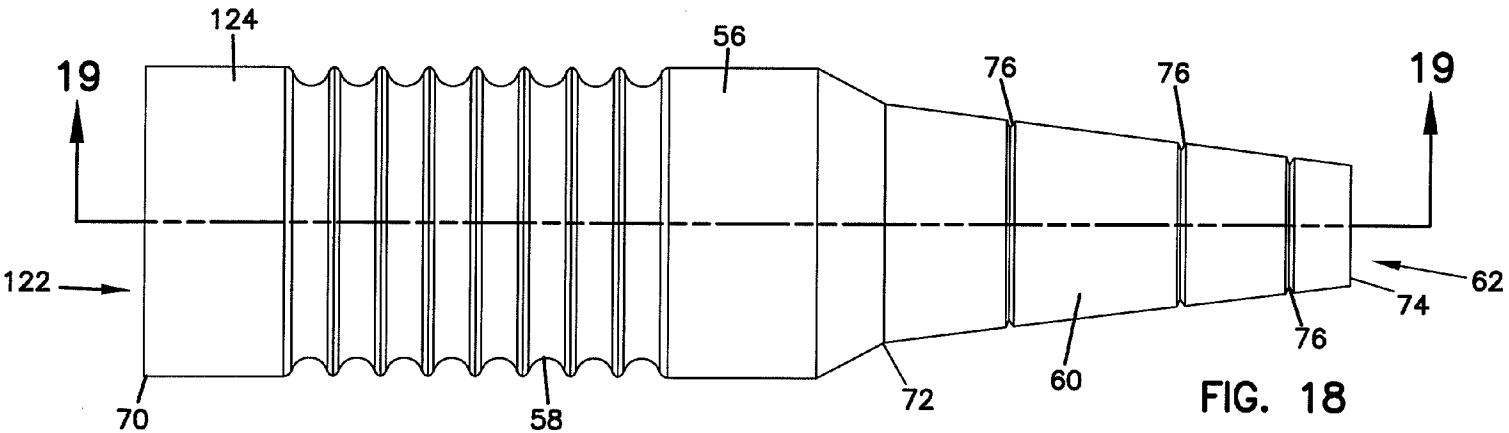
FIG. 18 is a side view of the protective boot of FIG. 17.
Figure 19:
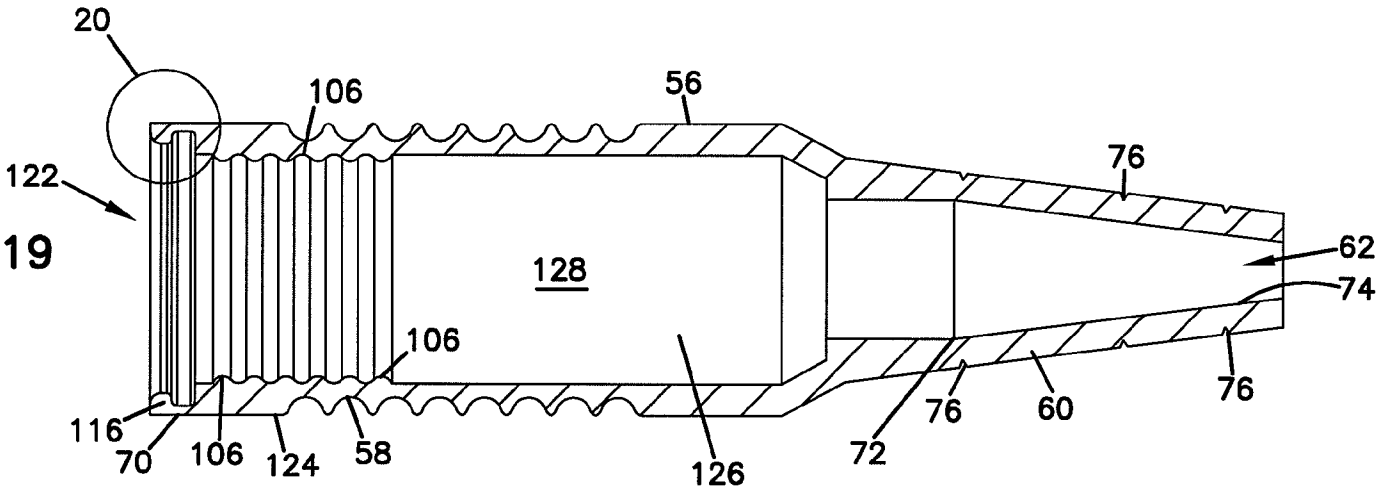
FIG. 19 is a cross-sectional view of the protective boot of FIG. 17, taken along line 19-19 in FIG. 18.

Referring now to FIGS. 16 and 21, connector 42 includes mating end 46 with a distal end 47. Mating ends 44 and 46 (shown in FIG. 12, above) electrically and physically mate with each other with mating 44 inserted within mating 46 (as shown in FIG. 3, above). When inserted within connector assembly 52, second end 86 of endcap 78 extends about mating end 46 and within inner wall 128. When endcap 78 is fully inserted within connector assembly 52 such that inward facing lip 116 of boot 56 engages outward facing lip 120 of endcap 78 to form junction 114, a second intermediate wall 118 within endcap 78 engages distal end 47 of mating end 46. Second end 86 is sized and configured to fit closely about mating end 46 so that endcap 78 may also be used with connector 42 which is not mounted within boot 56. Junction 114 would not be formed, as there would be no inwardly facing lip 116 to engage outwardly facing lip 120. However, endcap 78 would still be held securely and removably to mating end 46 of connector 42 by friction between second end 86 and mating end 46. Second intermediate wall 120 of endcap 78 would also engage distal end 47 of mating end 46.

Figure 20:
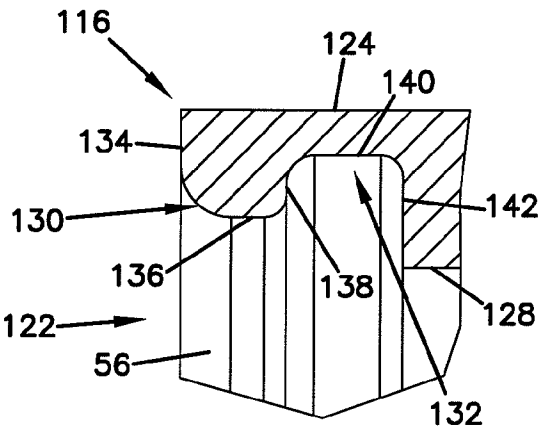
FIG. 20 is a closer view of a lip along a distal end of the boot of FIG. 17, corresponding with circle 20 of FIG. 19.
Figure 22:
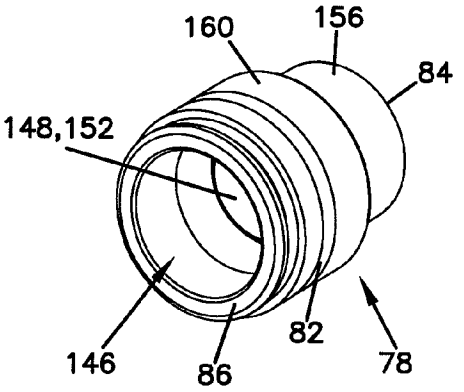
FIG. 22 is a perspective view of the protective endcap of FIG. 4.
Figure 23:
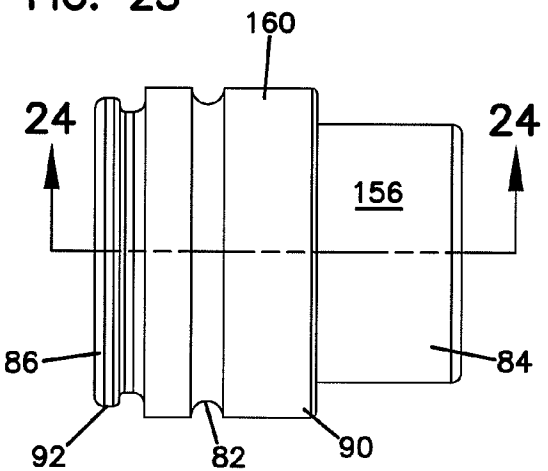
FIG. 23 is a side view of the protective endcap of FIG. 22.
Figure 25:
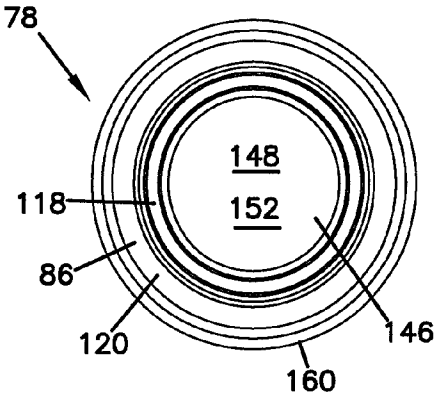
FIG. 25 is an end view of the protective endcap of FIG. 22.
Figure 24:
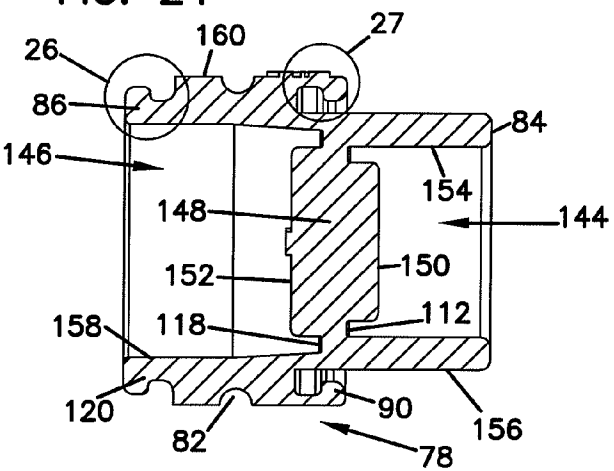
FIG. 24 is a cross-sectional view of the protective endcap of FIG. 22, taken along line 24-24 in FIG. 23.

Referring now to FIG. 20, inward facing lip 116 includes an inward facing circumferential ridge 130 and an inward facing circumferential groove 132. Ridge 130 is defined by a distal end face 134, a raised outward facing surface 136 and a first end face 138. Groove 132 is defined by first end face 138, a base 140 and a second end face 142 which extends inward from base 140 to inner wall 128 of boot 56. As shown, circumferential groove 132 is sized to receive an outward facing ridge of a similar size and shape to circumferential ridge 130. Alternatively, ridge 130 and groove 132 could be of different sizes and shapes.

Referring now to FIGS. 11 and 20, lips 92 and 116 are shaped and configured to cooperatively engage each as shown in FIGS. 1 to 3. Ridge 103 and groove 99 receive and mate with groove 132 and ridge 130, respectively, to form junction 66. As shown, each of ridges 103 and 130, and grooves 99 and 132 are similarly shaped and sized. However, the shape and size of the ridges and grooves may be varied, provided that they cooperate to form junction 66. Boots 54 and 56 are made of rubber so that lips 92 and 116 may deform and pass across each other to engage corresponding grooves and ridges to form junction 66, when the boots are mounted about connectors 40 and 42 in connector assemblies 50 and 52, respectively. It is anticipated that other similar resilient, deformable materials that are electrically non-conductive, such as any of a variety of plastics, may be used as well.

Figure 6:
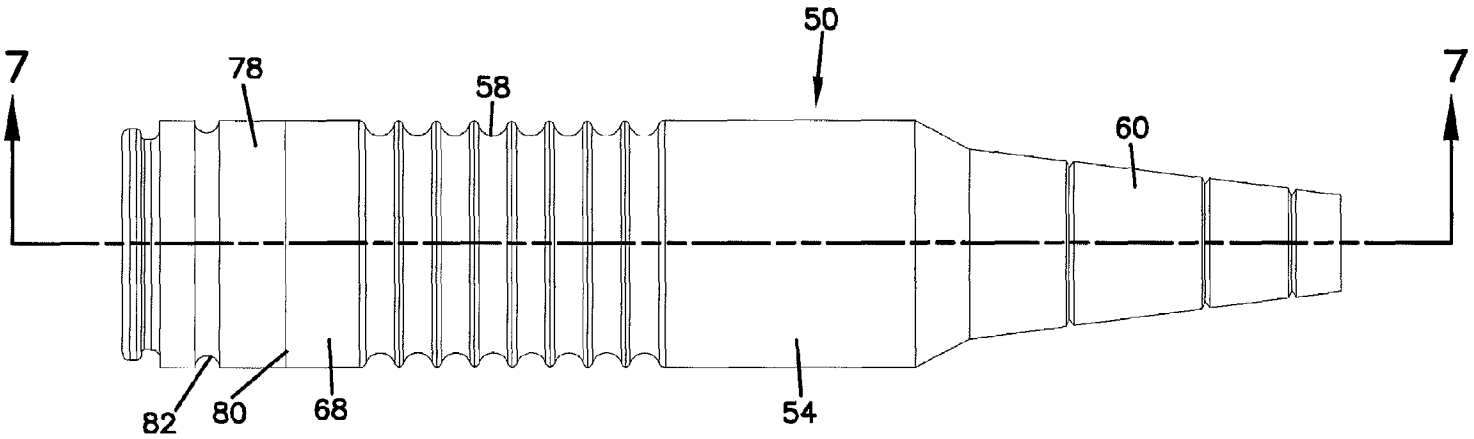
FIG. 6 is a side view of the triaxial connector of FIG. 4.
Figure 15:
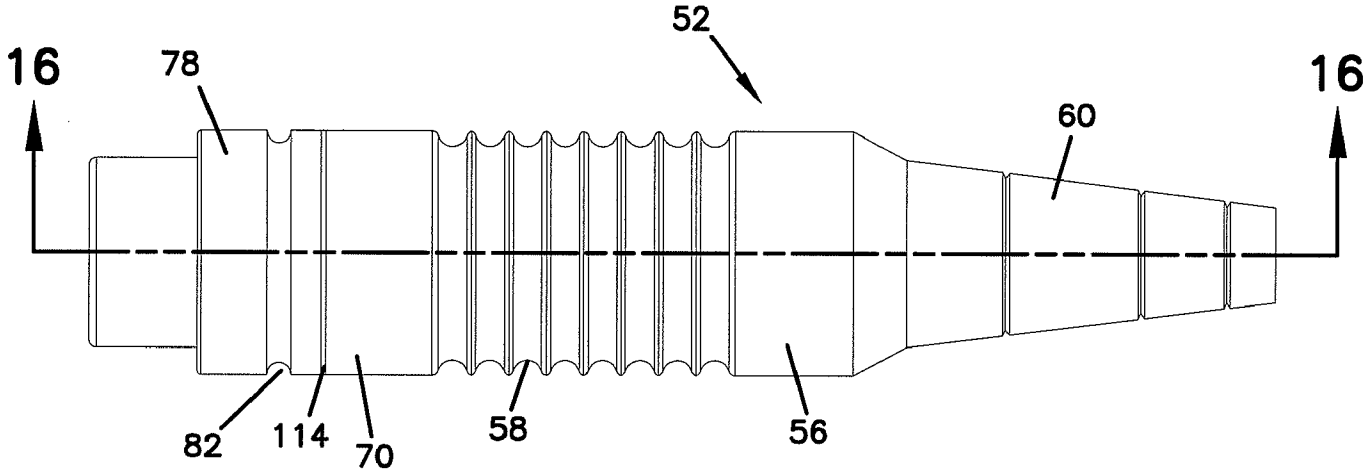
FIG. 15 is a side view of the triaxial connector of FIG. 13.

Referring now to FIGS. 22 to 27, endcap 78 includes a body 79 with first end 84 and second end 86. First end 84 of body 79 defines a first open end 144 for receiving mating end 44 of connector 40. First open end 144 is defined by an inner wall 154, which is sized to fit closely about mating end 44. Inner wall 154 provides a friction fit of endcap 78 to connector 40 in the absence of boot 54. First inner wall 112 is in a recess of an inner face 150 of an inner bulkhead 148 within first open end 144. An outer wall 156 of first end 84 is sized to fit closely to inner wall 110 of boot 54. Second end 86 includes a second open end 146 for receiving mating end 46 of connector 42. Second open end 146 is defined by an inner wall 158, which is sized to fit closely about mating end 46. Inner wall 158 provides a friction fit of endcap 78 to connector 42 in the absence of boot 56. Second inner wall 118 is within a recess in a second inner face 152 of inner bulkhead 148 within second open end 146. Between lip 90 and lip 120 is an outer wall 160, within which finger groove 82 is formed. As can be seen in FIGS. 6 and 15, outer wall 160 and finger groove 82 are accessible when endcap 78 is positioned within either connector assembly 50 or 52.

Figure 26:
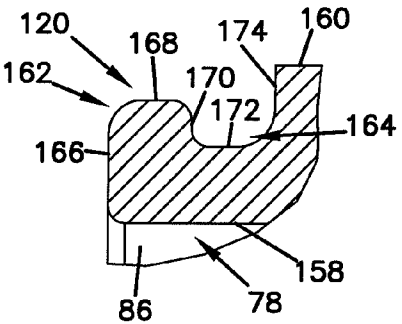
FIG. 26 is a closer view of a lip along a first end of the protective endcap, corresponding to circle 26 in FIG. 24.

Referring now to FIG. 26, outward facing lip 120 includes an outward facing circumferential ridge 162 and an outward facing circumferential groove 164. Ridge 162 is defined by a distal end face 166, a raised outward facing surface 168 and a first inner face 170. Groove 164 is defined by first inner face 170, a base 172 and a second inner face 174 extending between base 172 and outer wall 160.

Figure 27:
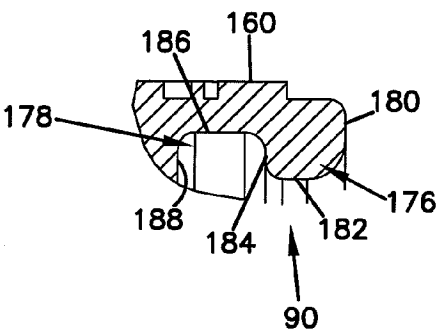
FIG. 27 is a closer view of a lip along an opposing second end of the protective endcap, corresponding to circle 27 in FIG. 24.

Referring now to FIG. 27, inward facing lip 90 includes an inward facing circumferential ridge 176 and an inward facing circumferential groove 178. Ridge 176 is defined by a distal end face 180, a raised inward facing surface 182 and a first inner wall 184. Groove 178 is defined by first inner wall 184, a base 186 and a second inner wall 188 extending between base 186 to outer wall 156 of first end 84.

As described above, lip 120 is sized to engage and mate with lip 116 of boot 56 and lip 90 is sized to engage and mate with lip 92 of boot 54. Ridge 162 and groove 164 of lip 120 are consistent in size and configuration with ridge 103 and groove 99 of lip 92. Ridge 176 and groove 178 are consistent in size and shape with ridge 130 and groove 132 of lip 116. Thus configured and shaped, endcap 78 may be used with either gender of a particular style of triaxial cable connector, whether the connectors are mounted within boots or not. To permit mating with mating ends of connectors 40 and 42, and with boots 54 and 56, endcap 78 is made of similar materials to boots 54 and 56.

Figure 28:
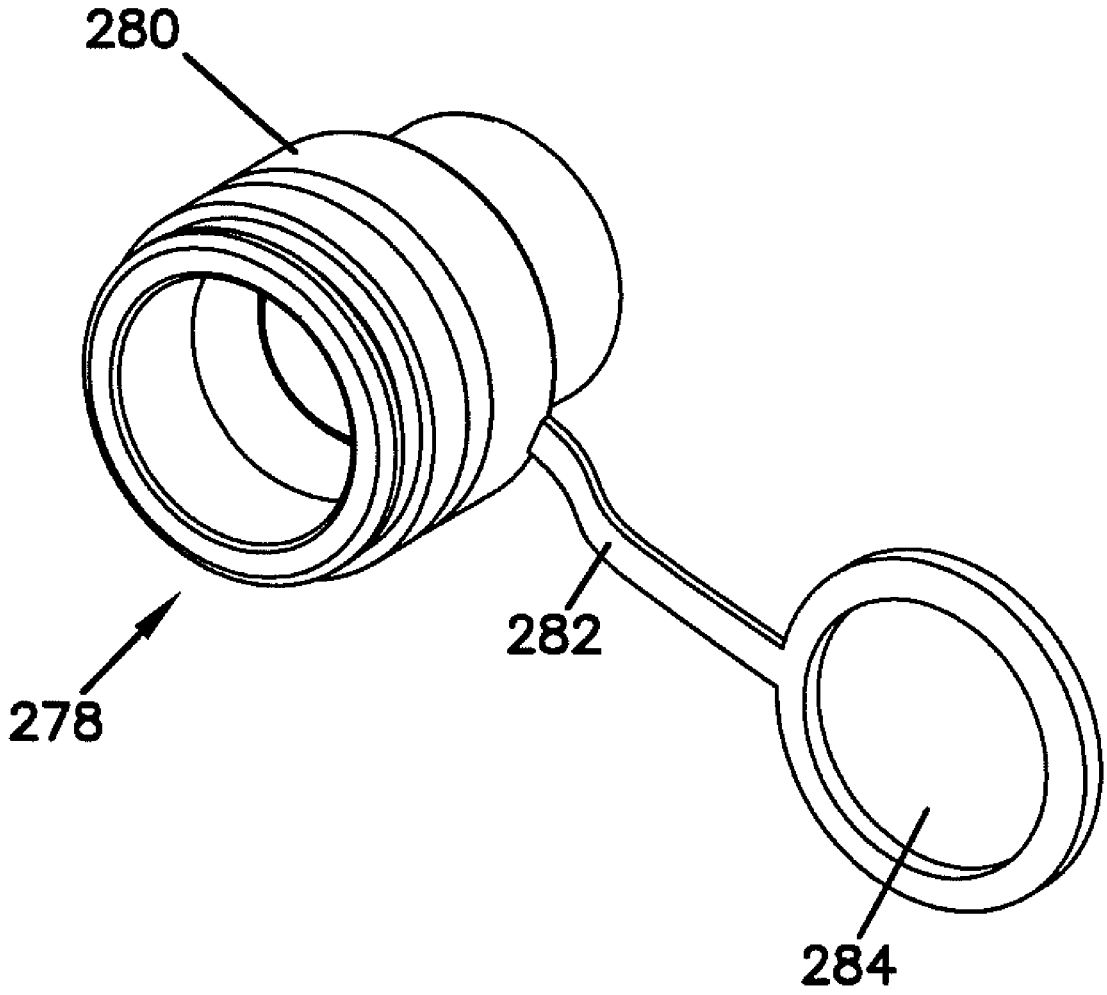
FIG. 28 is an alternative embodiment endcap according to the present invention.

It is anticipated that endcap 78 may also include a tether sized to fit about a boot or a connector. Such a tether would help prevent loss of endcaps and help ensure that an endcap is available when a cable is disconnected. Such a tether would also aid use of endcap 78 with a bulkhead type of triaxial connector, such as that described in commonly owned U.S. patent application Ser. No. 10/640,472, the disclosure of which is incorporated herein by reference. Such a tethered endcap 278 is shown in FIG. 28, and includes a body 280 which is similar to endcap 78 and a tether 282 with an opening 284. Opening 284 is sized to fit about an outer diameter of a triaxial connector such as connectors 40 and 42, or about an outer diameter of a connector assembly with a protective boot, such as connector assemblies 50 and 52. Alternatively, tether 282 could be integrally formed as part of either boot 54 or 56, so that endcap 278 is permanently attached to the boot.

Although the foregoing invention has been described in detail by way of illustration and example, for purposes of clarity of understanding, it will be obvious that changes and modifications may be practiced which are within the scope of the present invention as embodied in the claims appended hereto.

What is claimed is:

1. A protective endcap for use with a first cable connector and a second cable connector, the first and second cable connectors including mating ends and positioned within protective boots, the mating ends of the cable connectors adapted to electrically and physically mate with each other, the mating end of the first cable connector defining a first gender and the mating end of the second cable connector defining a second gender, the mating ends of the first and second cable connectors accessible through connector ends of the boot of each cable connector, the endcap comprising:

a body with a first end and an opposing second end, the first end adapted to mate with the mating end of the first cable connector and the second end adapted to mate with the mating end of the second cable connector;

the first end of the body including a first axial opening extending into the body, the first opening including a first intermediate wall sized to receive and engage the mating end of the first cable connector;

the second end of the body including a second axial opening extending into the body, the second opening including a second intermediate wall sized to receive and engage the mating end of the second cable connector;

the first end of the body including a first interlock arrangement for selectively engaging and forming a junction with the boot of the first cable connector and the second end of the body including a second interlock arrangement for selectively engaging and forming a junction with the boot of the second cable connector;

wherein the first and second intermediate walls define an inner bulkhead within the body, the inner bulkhead closing off each of the axial openings, the inner bulkhead defining a first inner face exposed to the first axial opening and a second inner face exposed to the second axial opening, the first and second inner faces each defining circumferential recesses.

2. The protective endcap of claim 1, further comprising an inward facing circumferential lip adjacent an outer wall defining the first end for selectively engaging the connector end of the boot of the first cable connector and the second end of the body includes an outward facing circumferential lip adjacent the second axial opening for selectively engaging the connector end of the boot of the second cable connector.

3. The protective endcap of claim 2, wherein the outward facing circumferential lip is adjacent the second end of the body and the inward facing circumferential lip is located at an intermediate location between the first end and the second end of the body.

4. The protective endcap of claim 1, further comprising a tether connected to the body for attaching the body to a connector.

5. The protective endcap of claim 1, wherein the endcap is configured to provide a friction-fit engagement between the first axial opening of the endcap and the mating end of the first cable connector.

6. The protective endcap of claim 1, wherein the endcap is configured to provide a friction-fit engagement between the second axial opening of the endcap and the mating end of the second cable connector.

7. The protective endcap of claim 1, wherein the endcap is configured such that the first end of the endcap can mate with the mating end of the first cable connector in the absence of the protective boot and the second end of the endcap can mate with the mating end of the second cable connector in the absence of the protective boot.

8. A protective endcap for use with a first cable connector and a second cable connector, the first and second cable connectors including mating ends and positioned within protective boots, the mating ends of the cable connectors adapted to electrically and physically mate with each other, the mating end of the first cable connector defining a first gender and the mating end of the second cable connector defining a second gender, the mating ends of the first and second cable connectors accessible through connector ends of the boot of each cable connector, the endcap comprising:

a body with a first end and an opposing second end, the first end adapted to mate with the mating end of the first cable connector and the second end adapted to mate with the mating end of the second cable connector;

the first end of the body including a first axial opening extending into the body, the first opening including a first intermediate wall sized to receive and engage the mating end of the first cable connector;

the second end of the body including a second axial opening extending into the body, the second opening including a second intermediate wall sized to receive and engage the mating end of the second cable connector;

the first end of the body including a first interlock arrangement for selectively engaging and forming a junction with the boot of the first cable connector and the second end of the body including a second interlock arrangement for selectively engaging and forming a junction with the boot of the second cable connector; and an inward facing circumferential lip adjacent an outer wall defining the first end for selectively engaging the connector end of the boot of the first cable connector and the second end of the body includes an outward facing circumferential lip adjacent the second axial opening for selectively engaging the connector end of the boot of the second cable connector.

9. The protective endcap of claim 8, wherein the outward facing circumferential lip is adjacent the second end of the body and the inward facing circumferential lip is located at an intermediate location between the first end and the second end of the body.

10. A protective endcap for use with a first cable connector and a second cable connector, the first and second cable connectors including mating ends and positioned within protective boots, the mating ends of the cable connectors adapted to electrically and physically mate with each other, the mating end of the first cable connector defining a first gender and the mating end of the second cable connector defining a second gender, the mating ends of the first and second cable connectors accessible through connector ends of the boot of each cable connector, the endcap comprising:

a body with a first end and an opposing second end, the first end of the body including a first interlock arrangement for selectively engaging and forming a junction with the connector end of the boot of the first cable connector and the second end of the body including a second interlock arrangement for selectively engaging and forming a junction with the connector end of the boot of the second cable connector, wherein the first end of the body is also configured to provide a friction-fit engagement with the mating end of the first cable connector and the second end of the body is also configured to provide a friction-fit engagement with the mating end of the second cable connector;

the first end of the body including a first axial opening extending into the body;

the second end of the body including a second axial opening extending into the body; and an inner bulkhead within the body, the inner bulkhead closing off each of the openings.

* * * * *